US007131748B2

(12) United States Patent
Kazar et al.

(10) Patent No.: US 7,131,748 B2
(45) Date of Patent: Nov. 7, 2006

(54) DECORATIVE LIGHTS WITH ADDRESSABLE COLOR-CONTROLLABLE LED NODES AND CONTROL CIRCUITRY, AND METHOD

(75) Inventors: Dennis Michael Kazar, Austin, TX (US); John Jeffery Oskorep, Chicago, IL (US)

(73) Assignee: Year-Round Creations, LLC, Chicago, IL (US)

( * ) Notice: Subject to any disclaimer, the term of this patent is extended or adjusted under 35 U.S.C. 154(b) by 165 days.

(21) Appl. No.: 10/758,143

(22) Filed: Jan. 15, 2004

(65) Prior Publication Data

US 2004/0150994 A1 Aug. 5, 2004

Related U.S. Application Data

(63) Continuation-in-part of application No. 10/678,934, filed on Oct. 3, 2003, now Pat. No. 6,933,680.

(60) Provisional application No. 60/415,968, filed on Oct. 3, 2002.

(51) Int. Cl.
*F21V 23/00* (2006.01)
*H05B 37/00* (2006.01)

(52) U.S. Cl. ..... 362/231; 362/252; 315/184

(58) Field of Classification Search ..... 362/231, 362/252; 315/184
See application file for complete search history.

(56) References Cited

U.S. PATENT DOCUMENTS 3,623,066 A 11/1971 Norris
3,789,211 A * 1/1974 Kramer ..... 362/231
3,946,244 A 3/1976 Davis, Jr.
4,153,860 A 5/1979 Vonick
4,215,277 A 7/1980 Weiner et al.
4,264,845 A * 4/1981 Bednarz ..... 315/323
4,455,562 A * 6/1984 Dolan et al. ..... 347/130
4,682,079 A 7/1987 Sanders et al.
4,713,586 A * 12/1987 Chiang ..... 315/200 A
4,780,621 A 10/1988 Bartleucci et al.
4,890,000 A 12/1989 Chou
4,992,704 A * 2/1991 Stinson ..... 315/312
5,008,595 A * 4/1991 Kazar ..... 315/178
5,245,519 A 9/1993 Openiano
5,300,864 A 4/1994 Allen, Jr.

(Continued)

FOREIGN PATENT DOCUMENTS

WO WO 99/10867 3/1999

(Continued)

OTHER PUBLICATIONS

DEFINITION: Addressable, Merriam-Webster On Line Dictionary, www.merriam.com/dictionary/addressable, Mar. 17, 2006.*

(Continued)

*Primary Examiner*—Thomas M. Sember
*Assistant Examiner*—Ismael Negron
(74) *Attorney, Agent, or Firm*—John J. Oskorep, Esq.

(57) ABSTRACT

A decorative lighting apparatus includes a decorative light strand having a plurality of addressable color-controllable red-green-blue (RGB) light-emitting diode (LED) nodes positioned therealong; a decorating selector which provides a plurality of user-selectable switch settings; control circuitry; and memory. The control circuitry selects, from the memory, stored holiday color data associated with a user-selectable switch setting and sends the holiday color data over one or more data lines to addressable color-controllable RGB LED nodes associated with LED node address data. Preferably, the plurality of holiday color schemes include color schemes for most major U.S. holidays including Christmas, Valentine's Day, St. Patrick's Day, Easter, Independence Day, and Halloween.

25 Claims, 6 Drawing Sheets

U.S. PATENT DOCUMENTS

| | | | | |
|---|---|---|---|---|
| 5,359,506 | A | 10/1994 | Koleno | |
| 5,629,587 | A * | 5/1997 | Gray et al. | 315/292 |
| 5,747,940 | A | 5/1998 | Openiano | |
| 5,749,646 | A | 5/1998 | Brittell | |
| 5,944,408 | A | 8/1999 | Tong et al. | |
| 5,980,062 | A | 11/1999 | Bell | |
| 6,015,218 | A | 1/2000 | Snell | |
| 6,033,089 | A | 3/2000 | Tesauro | |
| 6,050,701 | A | 4/2000 | Stone | |
| 6,150,774 | A * | 11/2000 | Mueller et al. | 315/291 |
| 6,299,338 | B1 | 10/2001 | Levinson et al. | |
| 6,309,086 | B1 | 10/2001 | Tomlinson | |
| 6,384,545 | B1 | 5/2002 | Lau | |
| 6,424,096 | B1 * | 7/2002 | Lowe et al. | 315/185 R |
| 6,577,080 | B1 | 6/2003 | Lys et al. | |
| 6,608,453 | B1 | 8/2003 | Morgan et al. | |
| 6,686,701 | B1 * | 2/2004 | Fullarton | 315/185 S |
| 6,690,120 | B1 | 2/2004 | Oskorep et al. | |
| 6,777,891 | B1 * | 8/2004 | Lys et al. | 315/291 |
| 2002/0048169 | A1 * | 4/2002 | Dowling et al. | 362/234 |
| 2002/0057061 | A1 * | 5/2002 | Mueller et al. | 315/291 |
| 2002/0101197 | A1 * | 8/2002 | Lys et al. | 315/291 |
| 2002/0145394 | A1 * | 10/2002 | Morgan et al. | 315/291 |
| 2002/0195975 | A1 * | 12/2002 | Schanberger et al. | 315/291 |
| 2003/0028260 | A1 * | 2/2003 | Blackwell | 700/18 |
| 2003/0072153 | A1 * | 4/2003 | Matsui et al. | 362/231 |
| 2003/0137258 | A1 * | 7/2003 | Piepgras et al. | 315/291 |
| 2003/0137851 | A1 * | 7/2003 | Pan | 362/540 |

FOREIGN PATENT DOCUMENTS

| | | | |
|---|---|---|---|
| WO | WO 99/31560 | | 6/1999 |
| WO | WO 02/069306 | A2 | 9/2002 |
| WO | WO 02/098182 | A2 | 12/2002 |
| WO | WO 03/026358 | A1 | 3/2003 |
| WO | WO 03/055273 | A2 | 7/2003 |
| WO | WO 03/067934 | | 8/2003 |

OTHER PUBLICATIONS

DEFINITION: Address, Merriam-Webster On Line Dictionary, www.merriam.com/dictionary/address, Mar. 17, 2006.*

Guerrero, Lucio; "End the Xmas light fight: Just leave them up"; Red Streak; Tuesday, Dec. 2, 2003; p. 6, vol. 22, No. 22, Chicago Sun-Times Inc.; Chicago, IL, USA.

Guerrero, Lucio; "Lights go up, never come down"; Chicago Sun-Times; Wednesday Dec. 3, 2003; p. 14, vol. 56, No. 258, Chicago Sun-Times Inc.; Chicago, IL, USA.

Mullins, Michelle; "No-fuss lighting"; Daily Southtowner; Thursday, Dec. 4, 2003; pp. B1 & B6, vol. 26, No. 282, Midwest Suburban Publishing; Chicago, IL, USA.

U.S. Appl. No. 10/678,934, Oskorep et al; Entitled "Decorative LightsWith At Least One Commonly Controlled Set of Color-Controllable Multi-Color LEDS For Selectable Holiday Color Schemes".

U.S. Appl. No. 10/763,658, Kazar et al; Entitled "Year-Round Decorative Lights withTime-Multiplexed Illumination of Interleaved Sets Of Color-Controllable LEDS".

U.S. Appl. No. 10/731,975, Oskorep et al; Entitled "Year-Round Decorative Lights With Selectable Holiday Color Schemes".

Select pages from www.colorkinetics.com of Color Kinetics, Inc.; published at least as of Dec. 17, 2003.

* cited by examiner

| | L1 | L2 | L3 | L4 | L5 | L6 | L7 | L8 | L9 | L10 | L11 | L12 |
|---|---|---|---|---|---|---|---|---|---|---|---|---|
| ... | | | | | | | | | | | | |
| OFF | | | | | | | | | | | | |
| NEW YEAR'S | W | W | W | W | W | W | W | W | W | W | W | W |
| VALENTINES/SWEET | R | R | W | W | R | R | W | W | R | R | W | W |
| JULY4/MEMORIAL | R | R | W | W | B | B | R | R | W | W | B | B |
| HALLOWEEN | O | O | O | O | O | O | O | O | O | O | O | O |
| THANKSGIVING | G | G | O | O | G | G | O | O | G | G | O | O |
| XMAS | R | R | G | G | R | R | G | G | R | R | G | G |
| HANUKKAH | B | B | Y | Y | B | B | Y | Y | B | B | Y | Y |
| PARTY 1 | B | B | W | W | B | B | W | W | B | B | W | W |
| PARTY 2 | R | R | R | R | O | O | O | O | B | B | B | B |
| ST. PATRICK'S | G | G | W | W | G | G | W | W | G | G | W | W |
| EASTER | Y | Y | Pi | Pi | Y | Y | Pi | Pi | Y | Y | Pi | Pi |
| ALL BLUE | B | B | B | B | B | B | B | B | B | B | B | B |
| ALL YELLOW | Y | Y | Y | Y | Y | Y | Y | Y | Y | Y | Y | Y |

102

400

DECORATIVE LIGHTS WITH ADDRESSABLE COLOR-CONTROLLABLE LED NODES AND CONTROL CIRCUITRY, AND METHOD

CROSS-REFERENCES TO RELATED APPLICATIONS

This application is a continuation-in-part of U.S. patent application Ser. No. 10/678,934 filed on Oct. 3, 2003 now U.S. Pat. No. 6,933,680 entitled "Decorative Lights With At Least One Commonly Controlled Set Of Color-Controllable LEDs For Selectable Holiday Color Schemes", which is based on U.S. Provisional Patent Application No. 60/415,968 filed on Oct. 3, 2002 entitled "Decorative Lights With At Least One Commonly Controlled Set Of Multi-Colored LEDs For Selectable Holiday Color Schemes", and U.S. patent application Ser. No. 10/144,149 filed on May 10, 2002 entitled "Year-Round Decorative Lights With Selectable Holiday Color Schemes", each application of which is hereby incorporated by reference herein.

BACKGROUND

1. Field of the Invention

The present invention relates generally to decorative lights such as decorative holiday lights (e.g. Christmas lights), and more particularly to decorative light strands having addressable color-controllable light-emitting diode (LED) nodes for user-selectable color schemes corresponding to major holidays and other occasions.

2. Description of the Related Art

Conventional decorative lights are typically fixed in color and celebratory purpose. One type of conventional light strand includes a plurality of lights which have the same single color (e.g. all white or all red). Another conventional light strand includes a plurality of lights which are multi-color (e.g. red, green, white, blue, and yellow) and lit all at the same time. Many of these lights are suitably colored for the Christmas holidays; e.g. solid red and green, although other multi-color combinations are popular. Some light strands provide for a "flashing" or "blinking" of lights in a random or set fashion. An end-user of Christmas lights typically hangs one or more light strands for the holiday (indoors or outdoors), and takes them down and puts them into storage after the holiday is over.

Holidays other than Christmas are celebrated as well, although light strands for these occasions are difficult to find if they even exist at all. For Independence Day and Memorial Day, the color combination of red, white, and blue is popular. For Hanukkah, the colors of blue and gold are popular. For Halloween, the color combination of orange and yellow is popular. For these and other celebrated holidays, an individual often purchases different decorations just before the holiday and hangs them up. For other occasions, such as parties, birthdays, anniversaries, showers, graduations, etc., one typically has to purchase other suitable decorations and decorate with them. These decorative items are hung up for the occasion and thereafter taken down.

Prior art related to the present application includes a Christmas light strand (manufacturer unknown) which has a button switch for providing eight (8) different lighting variations. The light strand has four (4) different colored lights in the following repeated sequence: red, green, orange, and blue. The lighting variations are described as follows: 1—"COMBINATION; 2—"IN WAVES"; 3—"TWINKLE/FLASH"; 4—"SLO-GLO"; 5—"SEQUENTIAL"; 6—"SLOW FADE"; 7—"CHASING/FLASH"; AND 8—"STEADY ON". For the $2^{nd}$, $3^{rd}$, $5^{th}$, and $7^{th}$ settings, somewhat random flashing of all of the colors are provided in subtle variations. For the $4^{th}$ and $6^{th}$ settings, fading in and out of all of the colors (in sequence and simultaneously, respectively) are provided. All colors are lit solid in the $8^{th}$ setting. Finally, the $1^{st}$ setting sequences through the $1^{st}$ through $7^{th}$ settings. This light strand and its settings are designed solely for Christmas; no different color schemes or holiday schemes are provided. The above-described light strand is representative of user-controllable time-sequenced lights suitable for Christmas or commercial applications.

The present invention relates to a "year-round" decorative light strand which provides for different color schemes which are selectable by the end user with use of a decorating selector/switch. Preferably, the different color schemes include U.S. holiday color schemes such as red & green for Christmas; red, white, & blue for Independence Day; green & white for St. Patrick's Day; etc. Patent applications related to such a year-round decorative light strand include U.S. Patent Application Publication US2003/0210547 filed on May 10, 2002 entitled "Year-Round Decorative Lights With Selectable Holiday Color Schemes"; and U.S. patent application Ser. No. 10,678,934 filed on Oct. 3, 2003 entitled "Decorative Lights With At Least One Commonly Controlled Set Of Color-Controllable Multi-Color LEDs For Selectable Holiday Color Schemes".

In a color-scheme-controllable light strand, however, the number of wired lines along the light strand may be relatively large depending on the design. In addition, there may be unattractive non-lit bulbs along the light strand in at least some selected color schemes. Further, there may be an expectation that the light strand have an increased life of use based on the year-round color scheme features that it provides. Finally, although such a light strand provides for different color schemes, there are limits on which colors may be utilized (e.g. uncommon colors such as purple or pink might not be provided). Accordingly, what is needed is a decorative lighting apparatus which overcomes the deficiencies of the prior art.

SUMMARY

A decorative lighting apparatus has user-selectable color schemes associated with holidays and other occasions for year-round use. In one illustrative embodiment of the present invention, the decorative lighting apparatus includes a decorative light strand having a plurality of addressable color-controllable red-green-blue (RGB) light-emitting diode (LED) nodes positioned therealong; a decorating selector which provides a plurality of user-selectable switch settings; control circuitry; and memory. The control circuitry is operative to illuminate the addressable color-controllable RGB LED nodes along the decorative light strand with a different holiday color scheme for each user-selectable switch setting. For each different holiday color scheme, the control circuitry selects stored holiday color data from the memory based on the user-selectable switch setting and sends the holiday color data over one or more data lines to addressable color-controllable RGB LED nodes associated with LED node address data. Preferably, the plurality of holiday color schemes include color schemes for most major U.S. holidays including Christmas, Valentine's Day, St. Patrick's Day, Easter, Independence Day, and Halloween. At least some holiday color schemes may be associated with two or more different holiday colors which are illuminated in a repeated interleaved pattern and may be scrolled along the light strand by the control circuitry. Advantageously, the decorative light strand may be hung permanently and utilized year-round for major holidays and other suitable occasions. In a color-scheme-controllable light strand, the use of RGB LED nodes as described provides for flexibility in the selection of a variety of different colors, reduces the number of wired lines to the lights, reduces the number of (or eliminates) non-lit bulbs for at least some color schemes, and provides the light strand with a long-life which is especially desirable in a year-round application.

DETAILED DESCRIPTION OF THE PREFERRED EMBODIMENTS

A decorative lighting apparatus has user-selectable color schemes associated with holidays and other occasions for year-round use. In one illustrative embodiment of the present invention, the decorative lighting apparatus includes a decorative light strand having a plurality of addressable color-controllable red-green-blue (RGB) light-emitting diode (LED) nodes positioned therealong; a decorating selector which provides a plurality of user-selectable switch settings; control circuitry; and memory. The control circuitry is operative to illuminate the addressable color-controllable RGB LED nodes along the decorative light strand with a different holiday color scheme for each user-selectable switch setting. For each different holiday color scheme, the control circuitry selects stored holiday color data from the memory based on the user-selectable switch setting and sends the holiday color data over one or more data lines to addressable color-controllable RGB LED nodes associated with LED node address data. Preferably, the plurality of holiday color schemes include color schemes for most major U.S. holidays including Christmas, Valentine's Day, St. Patrick's Day, Easter, Independence Day, and Halloween. Also preferably, at least some holiday color schemes may be associated with two or more different holiday colors which are illuminated in a repeated interleaved pattern and may be scrolled along the decorative light strand by the control circuitry. Advantageously, the decorative light strand may be hung permanently and utilized year-round for major holidays and other suitable occasions. In a color-scheme-controllable light strand, the use of RGB LED nodes as described provides for flexibility in the selection of a variety of different colors, reduces the number of wired lines to the lights, reduces the number of (or eliminates) non-lit bulbs for at least some color schemes, and provides the light strand with a long-life which is especially desirable in a year-round application.

Figure 1:
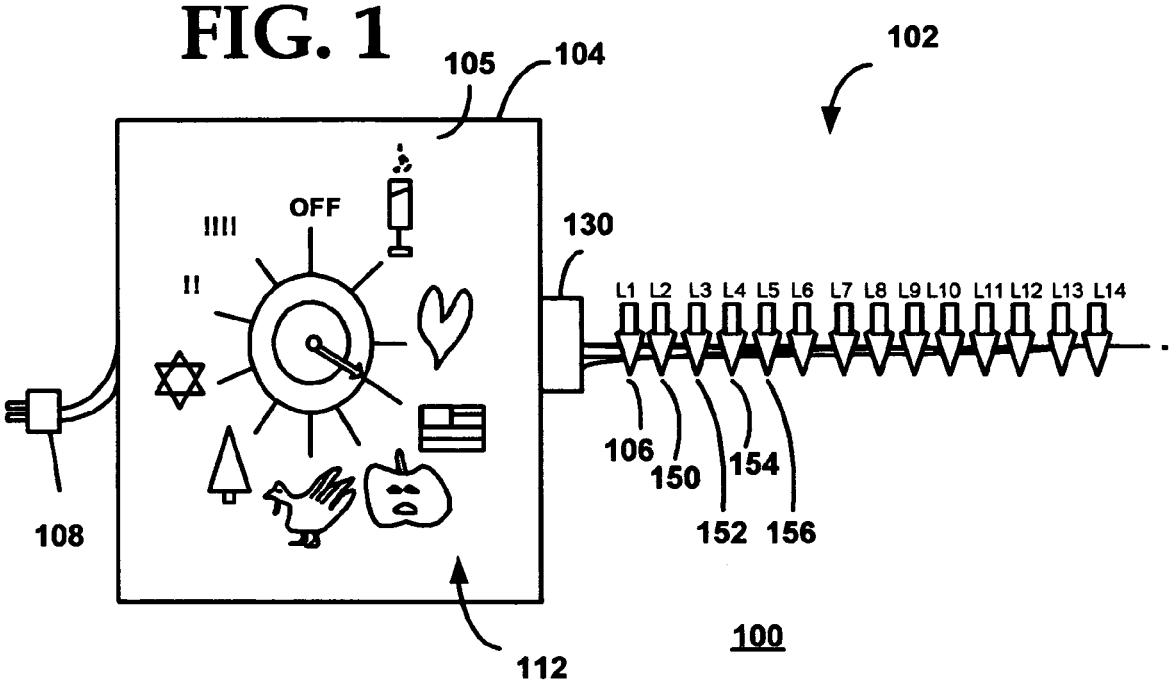
FIG. 1 is an illustration of a decorative lighting apparatus which includes an arrangement of color-controllable lights along a decorative light strand as well as a decorating selector, where each color-controllable light is part of an addressable color-controllable red-green-blue (RGB) light-emitting diode (LED) node.

FIG. 1 is an illustration of a decorative lighting apparatus 100 which includes an arrangement of color-controllable lights 102 along a decorative light strand and a decorating selector 104. In general, when decorative lighting apparatus 100 is plugged in and turned on, a plurality of wires 106 of the decorative light strand are controlled electronically to illuminate color-controllable lights 102 with different holiday color schemes. As will be described, the particular color scheme illuminated along the decorative light strand depends on the user switch setting from decorating selector 104.

Decorating selector 104 includes a housing 105 and a switch 112 which provides for a plurality of decorative holiday settings. Housing 105 is a small, relatively lightweight housing, preferably mostly of plastic construction, which is sized to be held in a human hand. In this embodiment, switch 112 is a 10-position rotary switch, single-throw. However, the number of positions of switch 112 may be more or less depending on how many decorative settings are desired. In an alternative embodiment, switch 112 is a conventional push-button switch which provides the plurality of different settings sequentially when pressing the button. Other alternative switches may be utilized, such as the switches shown and described later in relation to FIGS. 7 and 8. As an alternative or added feature, the decorative lighting apparatus may utilize a wireless remote control device for selecting one of the desired color schemes. In this case, a wireless receiver with antenna is contained within housing 105 for receiving a wireless signal from the wireless remote control device.

Attached to decorating selector 104 is a conventional AC power cord and plug 108 for connecting to a conventional AC outlet for supplying power to illuminate color-controllable lights 102. A power supply (which includes a transformer and/or rectifier, for example) may be included within housing 105 for AC-to-DC conversion. Alternatively, the power supply may not be an integral component of decorative lighting apparatus 100 but rather a separate off-the-shelf component which interfaces with decorative lighting apparatus 100. Also alternatively, electrical power may be supplied by one or more batteries which are coupled to a battery interface (not shown) of decorative lighting apparatus 100.

Figure 2:
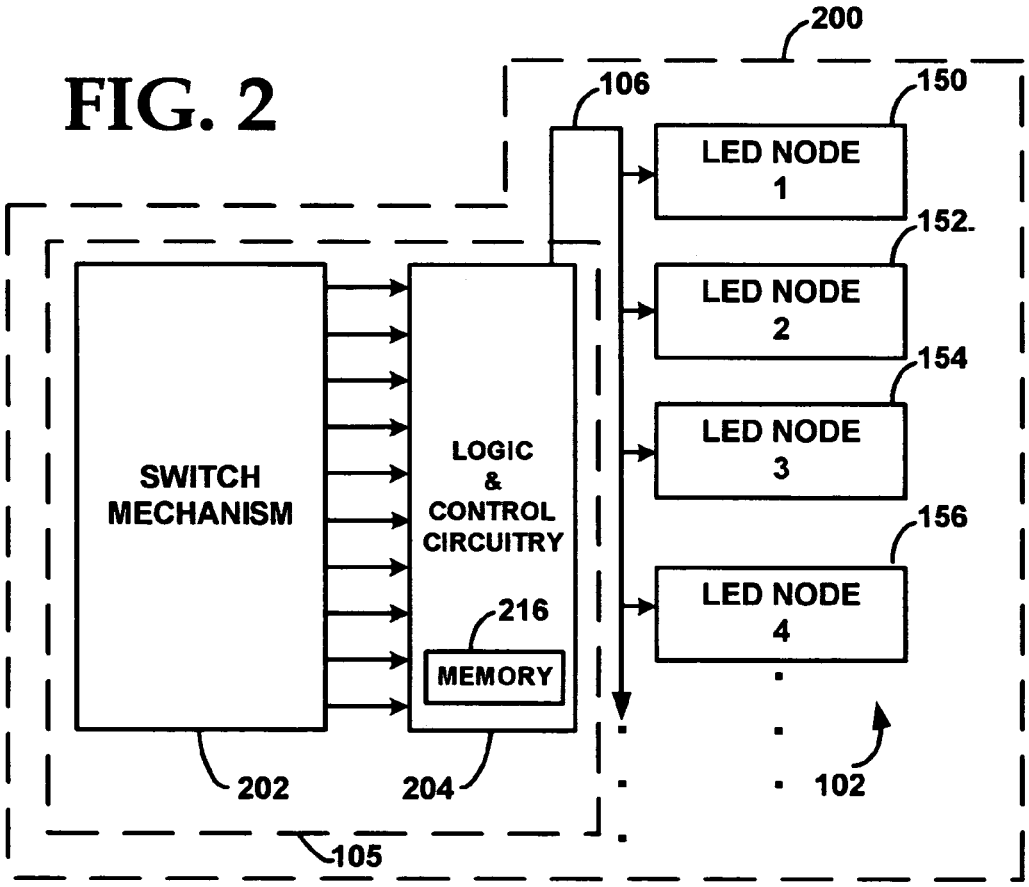
FIG. 2 is a schematic block diagram of basic electronics for the decorative lighting apparatus of FIG. 1.

FIG. 2 is a schematic block diagram of basic electronics 200 for decorative lighting apparatus 100 of FIG. 1. Electronics 200 of FIG. 2 include a switch mechanism 202, logic/control circuitry 204 which includes memory 216, and color-controllable lights 102. Logic/control circuitry 204 is contained within housing 105. As shown in FIG. 1, the switch 112 of switch mechanism 202 (FIG. 2) is visibly exposed outside housing 105 whereas the electronics of switch mechanism 202 are contained within housing 105. In the present embodiment, switch mechanism 202 has a plurality of logic outputs which change signal level based on the position of switch 112 (FIG. 1). Logic/control circuitry 204 is operative to read the signals from switch mechanism 202 and illuminate color-controllable lights 102 accordingly. Logic/control circuitry 204 may include a controller, a processor, logic gates, or combinations thereof. Preferably, logic/control circuitry 204 includes a microprocessor or microcontroller which is programmed with embedded software to perform the high-level functions described herein.

Color-controllable lights 102 are coupled to and along the plurality of wires 106 of the decorative light strand. In particular, color-controllable lights 102 are coupled to output lines (i.e. data output lines) from logic/control circuitry 204 so that they may be selectively colored based on the position of switch 112 (FIG. 1). Color-controllable lights 102 L1, L2, L3, and L4 may be physically spaced apart along wires 106 anywhere between about 1–13 centimeters, for example. Note that a male connecting plug 130 of FIG. 1 is attached at the front end of wires 106 and mates with a female connecting socket provided on housing 105. With the configuration provided in FIG. 1, decorating selector 104 and colored lights 102 may be separate and independent devices and sold separately from one another.

Figures 4, 5:
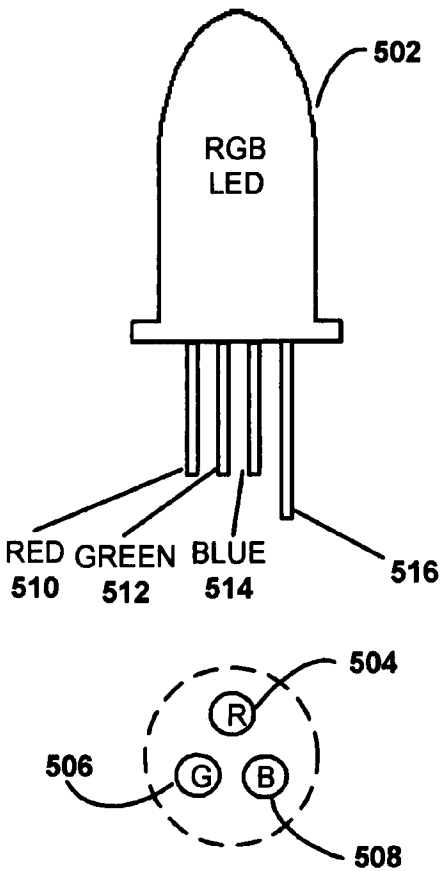
FIG. 4 is a color/light enabling scheme for the representative arrangement of color-controllable lights.
FIG. 5 is an illustration of a preferred color-controllable light for use in connection with the present invention, namely an RGB LED.

In the present application, color-controllable lights 102 include color-controllable Light-Emitting Diodes (LEDs) such as tri-color LEDs of the Red-Green-Blue (RGB) type. Referring ahead to FIG. 5, a color-controllable RGB LED 502 is illustrated. Referring to its internal structure, color-controllable RGB LED 502 includes a red LED 504 (as shown in a dashed insert) associated with a red control terminal 510, a green LED 506 (as shown in the dashed insert) associated with a green control terminal 512, and a blue LED 508 (as shown in the dashed insert) associated with a blue control terminal 514, which are packaged together as a single light source. A common ground terminal 516 is also utilized. Conventional color mixing techniques are performed with each RGB LED to produce most any color (i.e. colors other than red, green, and blue, for example, the colors orange, yellow, white, etc.).

In particular, each color-controllable RGB LED along the plurality of wires 106 is embodied at a node which is addressable and may be illuminated with an appropriate color by sending appropriate color data over data lines to an address associated with the node. The color mixing techniques are utilized locally at each node with its corresponding RGB LED to provide for a variety of colors other than red, green, and blue (e.g. orange, yellow, white, etc.). In FIGS. 1–2, each LED node is identified with a particular address represented by L1, L2, L3, L4, etc. Although only fourteen (14) LED nodes are shown in FIG. 1 (i.e. L1–L14), any suitable number of LED nodes may be provided along the light strand (e.g. 50 or 100 LED nodes). Such addressable color-controllable RGB LED nodes of a light strand may be provided by Color Kinetics Incorporated of Boston, Mass., U.S.A., with iColor Flex SL® which utilizes their Chromasic™ technology.

According to the present application, the decorative holiday settings provided by switch 112 of FIG. 1 provide for color schemes corresponding to most major U.S. holidays and other occasions. As apparent from the icons provided on housing 105 (via a thin plastic overlay adhesively attached on the housing), the holiday settings include (in clockwise order) a New Year's holiday setting, a Valentines/Sweetest Day holiday setting, an Independence/Memorial Day holiday setting, a Halloween holiday setting, a Thanksgiving holiday setting, a Christmas holiday setting, and a Hanukkah holiday setting. Also included are a Party-1 setting (!!) and a Party-2 setting (!!!!). Advantageously, this strand of decorative lights can be permanently hung and utilized year-round for major holidays and/or other suitable occasions.

In one illustrative example, the New Year's holiday setting illuminates all white colors in color-controllable lights 102; the Valentines/Sweetest Day holiday setting illuminates red and white colors (repeating sequence) in color-controllable lights 102 (e.g. L1–L2=red, L3–L4=white, repeat); the Independence/Memorial Day holiday setting illuminates red, white, and blue (repeating sequence) in color-controllable lights 102 (e.g. L1–L2=red, L3–L4=white, L5–L6=blue, repeat); the Halloween holiday setting illuminates all orange colors in color-controllable lights 102; the Thanksgiving holiday setting illuminates green and orange colors (repeating sequence) in color-controllable lights 102 (e.g. L1–L2=green, L3–L4=orange, repeat); the Christmas holiday setting illuminates red and green colors (repeating sequence) in color-controllable lights 102 (L1–L2=red, L3–L4=green, repeat); and the Hanukkah holiday setting illuminates blue and yellow/gold colors (repeating sequence) in color-controllable lights 102 (L1–L2=blue, L3–L4=yellow or gold, repeat). Also, the Party-1 setting illuminates blue and white colors (repeating sequence) in color-controllable lights 102 (L1–L2=blue; L3–L4=white, repeat), and the Party-2 setting illuminates red, orange, and blue colors (repeating sequence) in color-controllable lights 102 (L1–L4=red; L5–L8=orange; L9–L12=blue; repeat). As apparent, many of the color schemes include at least two colors which are illuminated a repeated interleaved pattern along the decorative light strand. Several variations of the repeated interleaved pattern may be utilized; for example, for the Christmas holiday setting the repeated interleaved pattern may be: L1=red; L2=red; L3=green; L4=red; L5=green; L6=red; L7=red; L8=green; L9=red; L10=green; L11=red; L12=red; L13=green; L14=red; L15=green; etc. (which essentially is L1=red; L2=red; L3=green; L4=red; L5=green; repeat).

Figure 3A:
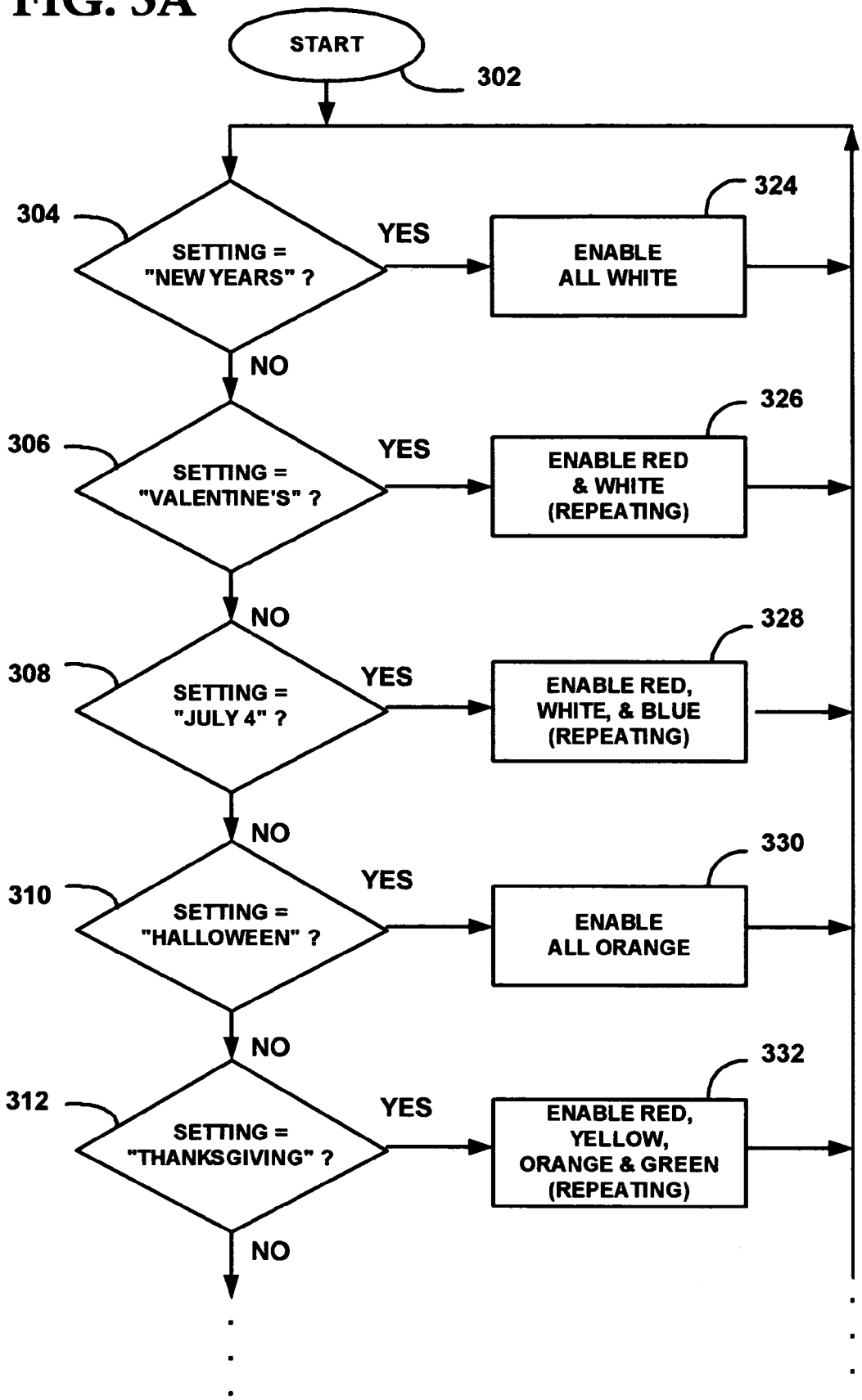
FIGS. 3A & 3B form a flowchart which describes a method of selecting color schemes with the decorative lighting apparatus of FIGS. 1 and 2.
Figure 3B:
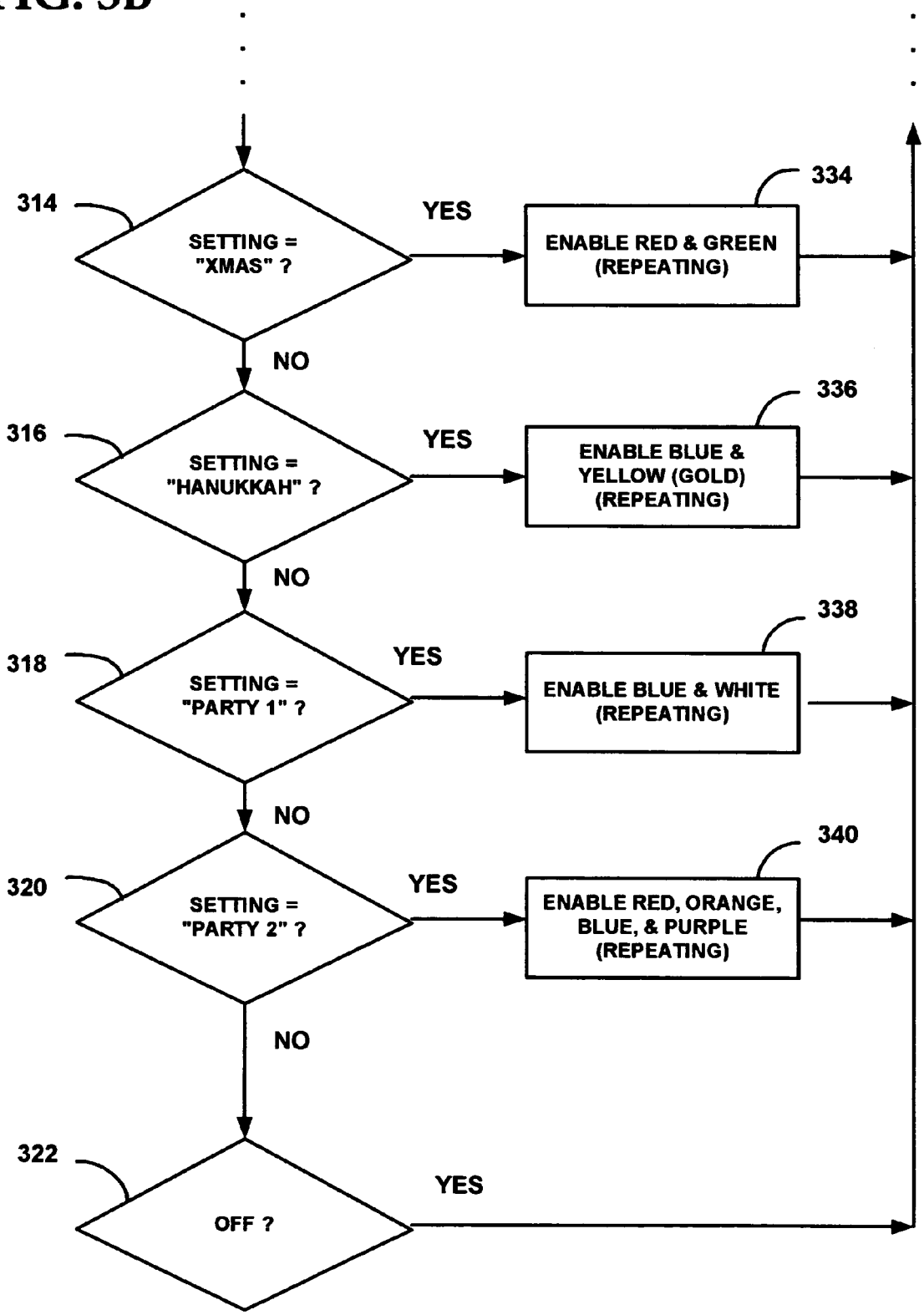

FIG. 3 is a flowchart which describes a method of selecting holiday color schemes using the decorative lighting apparatus 100 of FIG. 1. Beginning at a start block 302 in FIG. 3, if the switch setting is detected to be "New Year's" (step 304), then the logic/control circuitry enables white colors only (step 324). If the switch setting is detected to be "Valentines/Sweetest Day" (step 306), then the logic/control circuitry enables red and white colors only (step 326). If the switch setting is detected to be "July 4/Memorial Day" (step 308), then the logic/control circuitry enables red, white, and blue colors only (step 328). If the switch setting is detected to be "Halloween" (step 310), then the logic/control circuitry enables orange colors only (step 330). If the switch setting is detected to be "Thanksgiving" (step 312), then the logic/control circuitry enables green and orange colors only (step 332). If the switch setting is detected to be "Christmas" (step 314), then the logic/control circuitry enables red and green colors only (step 334). If the switch setting is detected to be "Hanukkah" (step 316), then the logic/control circuitry enables blue and yellow/gold only (step 336). If the switch setting is detected to be "Party-1" (step 318), then the logic/control circuitry enables blue and white colors only (step 338). If the switch setting is detected to be "Party-2" (step 320), then the logic/control circuitry enables red, orange, blue, and purple colors only (step 340). If the switch setting is detected to be "Off" (step 322), then no lights are enabled with any color. The switch setting is continuously monitored so that, when set differently, the appropriate decorating lighting scheme is displayed.

Referring now to FIG. 4, a light arrangement table 400 which shows the color/light enabling scheme in the color-controllable lights 102 based on the user switch setting. This figure illustrates how a portion of the decorative light strand (portion from L1–L12) may appear when particular color schemes are selected. A letter code in the table 400 indicates which particular color is illuminated in the lights: W=White; R=Red; B=Blue; Y=Yellow; O=Orange; G=Green; Pu=Purple; Pi=Pink; no letter code=OFF. Other examples of color schemes are shown, such as St. Patrick's Day corresponding to green and white colors (repeating sequence); Easter corresponding to yellow and pink colors (repeating sequence); all blue colors; and all yellow colors, etc. Note that there is a preference to use at least two different colors in each color scheme; for example, it is preferred that most of the U.S. holiday color schemes utilize at least two different colors.

Note that other suitable color schemes may be provided and the above are merely examples. The Christmas color scheme may illuminate four different colors (e.g. a repeating sequence of red, green, yellow, and blue); the Valentine's Day color scheme may illuminate red lights only; the Halloween color scheme may illuminate orange and yellow colors, etc. Preferably, other holidays and occasions are provided for as well, including Cinco de Mayo (red, white, and green colors) and Mardi Gras (purple, green, and gold colors). In addition, additional settings correspond to a simple single-color illumination along the entire light strand for each primary and secondary color. Further, additional color schemes corresponding to holidays or occasions suitable in other countries (non-U.S. countries) may be provided. The settings may be suitable for providing a plurality of different geographical regional color schemes such as different flag colors for different states (U.S. states such as Arizona, Colorado, Maine, etc.) or countries (France, Germany, Italy, China, etc.) or different holiday color schemes for any non-U.S. country or countries. Even more additional settings provide color schemes which correspond to a plurality of different sports teams such as different football teams (Chicago Bears, New York Giants, San Diego Chargers, etc.), baseball teams, soccer teams, hockey teams, etc. Preferably, any dominancy color in a color scheme (e.g. white in Japan's national flag, or navy blue in the Chicago Bears color scheme) may be accounted for in an additional or more relatively proportionate number of illuminated colors in the decorative light strand. In a 50 LED node light strand, for example, a national flag color scheme for Japan would provide 40 LED nodes with the color white and 10 LED nodes with the color red. As another example, a Chicago Bears color scheme would provide 35 LED nodes with the color navy blue and 15 LED nodes with the color orange.

Preferably, each color scheme provided for does not change over time and remains generally fixed in color(s). However, this does not mean that the colors must be continuously illuminated or fixed in position; the colors may indeed be flashed, alternating, and/or "moved" along the decorative light strands in any suitable predictable or random fashion.

Figure 6:
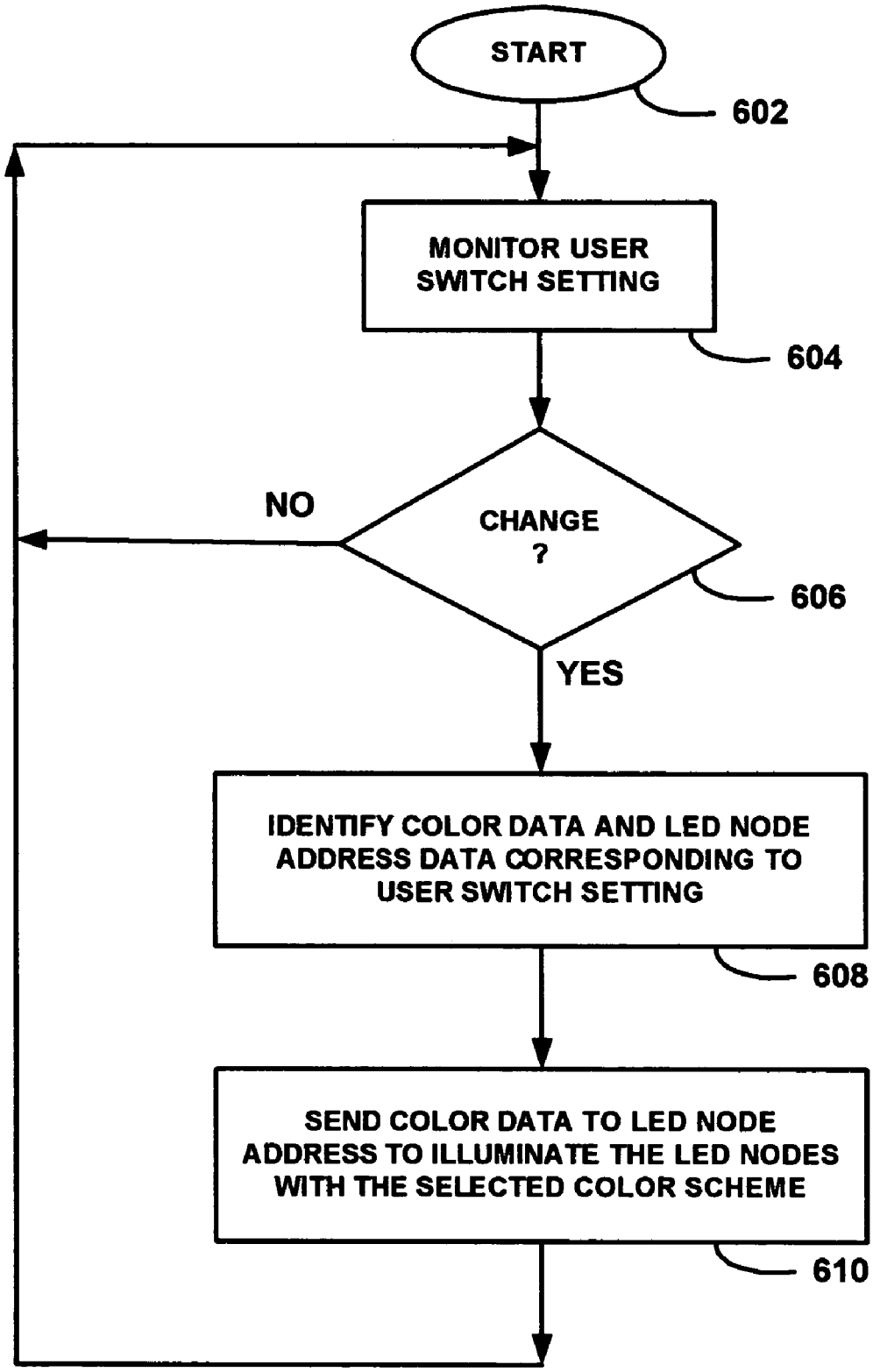
FIG. 6 is a flowchart which describes a method of providing control in a decorative lighting apparatus for user-selectable color schemes according to the present invention.

Referring back to FIG. 2, logic/control circuitry 204 preferably includes a microprocessor or microcontroller programmed with embedded software to accomplish high-level functions described herein. Memory 216 is preprogrammed to store data corresponding to all or a limited subset of the color schemes described above. Referring now to FIG. 6, a flowchart which describes an operating method of the logic/control circuitry 204 for user-selectable color schemes is shown. Beginning at a start block 602 of FIG. 6, user switch settings of the decorating selector or switch are monitored (step 604). If no change in the user switch setting is identified (step 606), then monitoring of the user switch settings are continued at step 604. If a change in the user switch setting is identified (step 606), then color scheme data corresponding to the user switch setting are identified (step 608). The color scheme data include color data associated with LED node addresses. Preferably, the color scheme data are stored in memory in association with corresponding LED node addresses and appropriately selected therefrom based on the user switch setting. The color data are sent over the data lines to the associated LED node addresses to illuminate the light strand with the selected color scheme (step 610). The color scheme remains illuminated along the decorative light strand until the next color scheme is selected, where the method repeats at step 604.

Preferably, the memory stores a single one-to-one LED-node-address-to-color-data relationship for each color scheme to conserve memory. For example, if a 50 LED node light strand is utilized, at most there may be 50 LED node addresses corresponding to 50 color data items for the color scheme. As another example using the 50 LED node light strand, there may be a maximum of 4 color data items per color scheme, where each color data item is linked to some or all of the 50 LED node addresses.

Again, it is preferred that the colors in each color scheme remain the same over time. However, this does not mean that the colors must be continuously illuminated or fixed in position over time; the colors may indeed be flashed, alternated over time, and/or "moved" along the decorative light strands in any suitable predictable or random fashion. Instead of providing additional LED-node-address-to-color-data in memory for any "effects" in each color scheme, such effects are provided by utilizing common software algorithms which may be used for some if not all color schemes. Where such an algorithm(s) is utilized, steps 608 and 610 of FIG. 6 are repeated so as to provide such effect along the decorative light strand over time. Note that such a software algorithm utilizes the same color data as provided in the LED-node-address-to-color data relationship to maintain color-consistency with the selected color scheme. One software algorithm may provide for a predictable "flashing" of the color scheme; in this case some or all of the LED nodes are repeatedly controlled from ON-to-OFF by sending appropriate data to them at an appropriate time. Another software algorithm may provide for a "random sparkling" of the color scheme; in this case some LED nodes selected by random-number generation are controlled from ON-to-OFF or lower intensity repeatedly by sending appropriate data to them at an appropriate time.

As previously described, at least some of the color schemes are associated with two or more different colors which are illuminated in a repeated interleaved pattern. These color schemes may be "scrolled" along the decorative light strand by the control circuitry. Where such scrolling or color movement is performed, steps 608 and 610 of FIG. 6 are repeated using a scrolling algorithm. The following is provided as an example of an algorithm which increases/decreases an address index to provide color-scheme scrolling: during time period 1, L1=red, L2=red, L3=white, L4=white, L5=green, L6=green, repeat; during time period 2, L1=green, L2=red, L3=red, L4=white, L5=white, L6=green, repeat; during time period 3, L1=green, L2=green, L3=red, L4=red, L5=white, L6=white, repeat; during time period 4, L1=white, L2=green, L3=green, L4=red, L5=red, L6=white, repeat; during time period 5, L1=white, L2=white, L3=green, L4=green, L5=red, L6=red, repeat; etc. Each time period may be, for example, between ¼milliseconds to 4 seconds, and/or can be varied by the end user.

The software which is programmed to cause the color schemes to be illuminated in response to user switch settings is preferably stored in read-only memory (ROM) in a "hardcoded" fashion, whereas the data to provide the color schemes are stored in an erasable and/or rewritable memory such as an electronically erasable/programmable ROM (EEPROM) or FLASH memory. Therefore, from product to product, the hardcoded software in ROM need not be different or ever change if the microprocessor/microcontroller is provided or utilized with a reprogrammable memory in which the color scheme data is stored. This approach is particularly advantageous so that a variety of different product lines that differ only by pre-programmed color scheme data (and e.g. a plastic icon overlay or other color scheme indication) may be easily manufactured.

Figure 7:
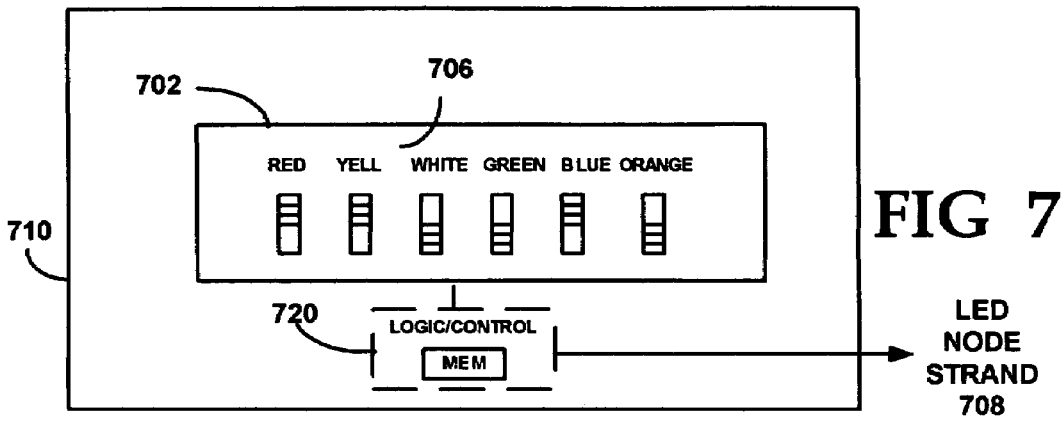
FIG. 7 is a dip switch which may be utilized as the decorating selector for selecting colors of the color-controllable lights.

FIG. 7 is a different configuration where an alternative switch 702 is utilized for the decorating selector 104 of FIG. 1 for selecting colors in the lights. In this embodiment, switch 702 is actually a dip switch which provides for the selection of specific colors to be turned on/off. A housing 710 carries the dip switch, which is coupled to logic/control circuitry 720. Logic/control circuitry 720 includes memory and is contained within housing 710. A color-controllable LED node strand 708 is coupled to logic/control circuitry 720 and may be directly connected to housing 710. An exposed switch portion 706 on housing 710 reveals settable color-control switches which include red, yellow, white, green, blue, and orange; however additional color switches associated with different colors may be provided. Color indicators are provided on a surface of housing 710. In an alternative embodiment, switch 702 is provided in a housing separate from housing 710 but has a cable which is directly attached to it. The decorative lighting apparatus in this embodiment generally has a similar structure and functionality as that described in relation to FIGS. 1–6, where decorative outcomes similar to those described may be achieved utilizing a dip switch technique such that the end-user has complete control over each color.

Specifically, the memory of logic/control circuitry 720 of FIG. 7 includes color data corresponding to each color that is associated with a color-control switch. Alternatively, the memory includes color scheme data corresponding to each setting combination of color-control switches in switch 702. Logic/control circuitry 720 is operative as follows. If only a first switch associated with a first color (e.g. red) is set by the end user, then logic/control circuitry 720 identifies and sends the appropriate color data to the LED nodes to set them all to red. If subsequently a second switch associated with a second color (e.g. white) is set by the end user, then logic/control circuitry 720 identifies and sends appropriate color data to LED nodes to change the color in at least some or all of them so that a repeated interleaved sequence of red and white is provided along the decorative light strand (e.g. L1=red, L2=white, repeat). If subsequently a third switch associated with a third color (e.g. blue) is set by the end user, then logic/control circuitry 720 identifies and sends appropriate color data to LED nodes to change the color in at least some or all of them so that a repeated interleaved sequence of red, white, and blue is provided along the decorative light strand (e.g. L1=red, L2=white, L3=blue, repeat). Light colors may be removed by the end user by unsetting the corresponding switch. Alternatively, or in addition to utilizing such a switch in FIG. 7, it may be desirable to utilize a plurality of user-selectable potentiometers as part of the switch to provide the end user with maximum control over the variety of colors illuminated in the color-controllable lights. In any case, for each one of all possible combinations of one or more user-selectable color-control switches which have been set, the control circuitry illuminates the addressable color-controllable LED nodes with a color scheme corresponding to the one or more user-selectable color-control switches.

Figure 8:
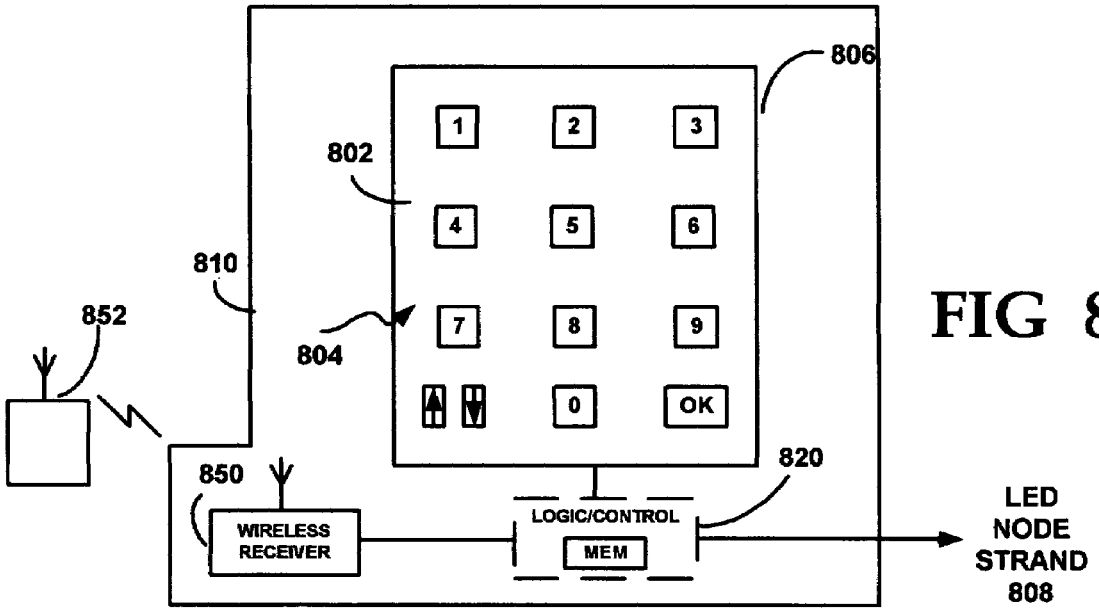
FIG. 8 is a keypad which may be utilized as the decorating selector for selecting color schemes in the color-controllable lights.

FIG. 8 shows another alternative switch 802 which may be utilized for the decorating selector 104 of FIG. 1. In this embodiment, switch 802 is a keypad which provides for the selection of many preprogrammed holiday color schemes. A housing 810 carries the keys of the keypad, which is coupled to logic/control circuitry 820. Logic/control circuitry 820 includes memory and is contained within housing 810. A color-controllable LED node strand 708 is coupled to logic/control circuitry 820 may be directly connected to housing 810. In an alternative embodiment, switch 802 is provided in a housing separate from housing 810 but has a cable which is directly attached to it. An exposed keypad portion 806 on housing 810 reveals user-settable switches which include keys 804 corresponding to 0 to 9, "OK", and scheme-select switches FORWARD and BACK.

If wireless remote switching is utilized, a wireless receiver 850 is contained within housing 810 and coupled to logic/control circuitry 820; the keypad is part of a wireless remote controller 852 which is battery-operated. Provided as a separate unit, wireless remote controller 852 with the keypad includes a wireless transmitter and a controller which is coupled to keypad inputs. The wireless technique may utilize well-known radio frequency (RF) or infrared communications, as examples. The wireless remote switching is important to provide an end user with mobility and thus visibility uniquely suited for the very different color schemes which may be illuminated at an inconvenient location (e.g. outside of the end user's house or building). This wireless remote switching may be used in connection with decorating selectors/switches other than a keypad, for example, the wireless remote switching may be utilized with the decorating selectors/switches shown and described in relation to FIG. 1 or FIG. 7.

The decorative lighting apparatus using switch 802 of FIG. 8 has a somewhat similar structure and functionality as that described in relation to FIGS. 1–6. The memory of logic/control circuitry 820 includes a stored list of color scheme data. Each listing of color scheme data is associated with one of a plurality of user-selectable entries (e.g. numeric entries) from the keypad, and includes color data and associated LED node address data. The color schemes may be alternatively controlled or set using the scheme-select FORWARD and BACK keys, which select forward or back from the current listing. Preferably, the user-selectable entries (e.g. the numeric entries) are printed in associated with an indication or name of the associated color scheme, either on housing 810 directly or on a separate instruction sheet. For example, the print may recite the following: 1=all white; 2=Valentines Day; 3=Easter; 4=Independence Day; 5=Cinco de Mayo; 6=Thanksgiving; 7=Mardi Gras; etc.

Preferably, the memory of the logic/control circuitry is configured to store data for all major U.S. holiday color schemes (such as those described herein) and at least a few more celebratory schemes. Even more preferably, the memory is configured to store preprogrammed data associated with at least ten (10) or at least twenty (20) different color schemes associated with various U.S. holidays, celebratory events, national flags, and sports teams, such as those described herein, with or without different effects such as flashing, fading, and/or movement. Most preferably, the memory is configured to store preprogrammed data associated with at least fifty (50) different schemes for various U.S. holidays, celebratory events, national flags, and sports teams, such as those described herein, with or without different effects such as flashing, fading, and/or movement.

Figure 9:
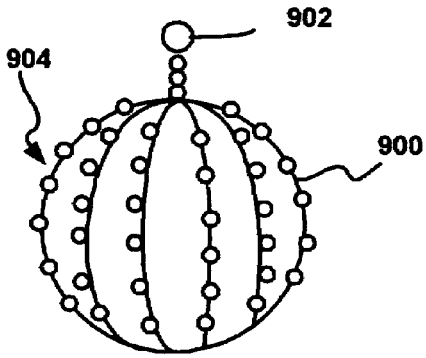
FIG. 9 is one example of an alternative decorative apparatus as a 3-dimensional structure (e.g. a decorative holiday ball).

FIG. 9 is an alternate embodiment of a decorative lighting apparatus. More particularly, FIG. 9 shows a decorative holiday ball 900 which may be hung from a ceiling by an attachment 902 (e.g., a chain or rope). In this embodiment, the decorative holiday ball 900 is made from a skeletal structure of light-weight metal or plastic which is formed into a sphere. This sphere is decorated with the color-controllable lights (i.e. the LED nodes), and could be decorated with other decorative materials such as decorative paper, streamers, etc. Ball 900 is configured to function in the same manner as that described in relation to FIGS. 1–8 and is selectively illuminated with a different color scheme based on the user-selectable setting. The sphere is just one example of a 3-dimensional structure which may be configured; other structures such as a block or a star may be made. Also alternatively, the structure may be a 2-dimensional structure which is formed into a rectangle or circle.

Final Comments. As described herein, a decorative lighting apparatus has user-selectable color schemes associated with holidays and other occasions for year-round use. In one illustrative embodiment of the present invention, the decorative lighting apparatus includes a decorative light strand having a plurality of addressable color-controllable red-green-blue (RGB) light-emitting diode (LED) nodes positioned therealong; a decorating selector which provides a plurality of user-selectable switch settings; control circuitry; and memory. The control circuitry is operative to illuminate the addressable color-controllable RGB LED nodes along the decorative light strand with a different holiday color scheme for each user-selectable switch setting. For each different holiday color scheme, the control circuitry selects stored holiday color data from the memory based on the user-selectable switch setting and sends the holiday color data over one or more data lines to addressable color-controllable RGB LED nodes associated with LED node address data. Preferably, the plurality of holiday color schemes include color schemes for most major U.S. holidays including Christmas, Valentine's Day, St. Patrick's Day, Easter, Independence Day, and Halloween. At least some holiday color schemes may be associated with two or more different holiday colors which are illuminated in a repeated interleaved pattern and may be scrolled along the decorative light strand by the control circuitry.

Advantageously, the decorative light strand may be hung permanently and utilized year-round for major holidays and other suitable occasions. It is highly advantageous to provide a relatively large number of preprogrammed color schemes with a simple decorating selector or switch, to provide a low-cost and easy-to-use versatile decorative lighting apparatus for an end user. In a color-scheme-controllable light strand, the use of RGB LED nodes as described provides for flexibility in the selection of a variety of different colors, reduces the number of wired lines to the lights, reduces the number of (or eliminates) non-lit bulbs for at least some color schemes, and provides the light strand with a long-life which is especially desirable in a year-round application.

A method of year-round holiday lighting with a decorative light strand may involve the steps of providing a decorative light strand which may be hung by an end user; in response to a first user switch setting of the decorative light strand, providing for a selective illumination of at least two holiday colors in the decorative light strand in accordance with a first holiday color scheme by sending first color data associated with the at least two holiday colors to different sets of addressable color-controllable red-green-blue (RGB) light-emitting diode (LED) nodes along the decorative light strand; and in response to a second user switch setting of the decorative light strand, providing for a selective illumination of at least two holiday colors in the decorative light strand in accordance with a second holiday color scheme by sending second color data associated with the at least two holiday colors to different sets of the addressable color-controllable RGB LED nodes along the decorative light strand.

Another decorative lighting apparatus with selectable color schemes may include a plurality of addressable color-controllable red-green-blue (RGB) light-emitting diode (LED) nodes along a decorative light strand; control circuitry; a decorating selector which provides a plurality of user-selectable color-control switches for illuminating a plurality of colors in the addressable color-controllable LED nodes; where the control circuitry is operative to, for each one of all possible combinations of one or more user-selectable color-control switches which have been set, illuminate the addressable color-controllable LED nodes with a color scheme corresponding to the one or more user-selectable color-control switches by: identifying color data associated with the one or more user-selectable color-control switches which have been set; and sending the color data over one or more data lines to addressable color-controllable LED nodes associated with LED node address data.

Yet another decorative lighting apparatus with user-selectable color schemes includes a decorative light strand which may be hung by an end user; a plurality of addressable color-controllable red-green-blue (RGB) light-emitting diode (LED) nodes along the decorative light strand; control circuitry; memory; a housing to which the decorative light strand may be attached; the control circuitry and the memory contained within the housing; the memory storing data for a plurality of at least ten (10) color schemes including U.S. holiday color schemes for Christmas, Independence Day, Halloween, Valentine's Day, and St. Patrick's Day; a decorating selector comprising a keypad which provides a plurality of user-selectable switch settings; where the control circuitry is operative to illuminate the addressable color-controllable LED nodes along the decorative light strand with a different color scheme for each user-selectable switch setting by: selecting, from the memory, color data for a color scheme associated with a user-selectable switch setting; and sending the color data over one or more data lines to addressable color-controllable LED nodes associated with LED node address data, for illuminating the addressable color-controllable LED nodes with the color scheme in response to the user-selectable switch setting. The color schemes may additionally include a plurality of state or national flag color schemes, and/or a plurality of sports team color schemes. A wireless receiver may be coupled to the control circuitry within the housing for use with a wireless remote controller which includes the keypad.

It is to be understood that the above is merely a description of preferred embodiments of the invention and that various changes, alterations, and variations may be made without departing from the true spirit and scope of the invention as set for in the appended claims. The several embodiments and variations described above can be combined with each other where suitable. The particular color schemes for the holidays and other occasions described herein are merely examples and may vary. As one skilled in the art will readily understand, the holiday color schemes may be enhanced by providing flickering, fading in and out, and/or positional movement using well-known conventional techniques. Few if any the terms or phrases in the specification and claims have been given any special particular meaning different from the plain language meaning, and therefore the specification is not to be used to define terms in an unduly narrow sense.

What is claimed is:

1. A decorative lighting apparatus with selectable color schemes, comprising:

a plurality of addressable color-controllable red-green-blue (RGB) light-emitting diode (LED) nodes along a decorative light strand;

a control circuitry;

a decorating selector which provides a plurality of user-selectable color-control switches for illuminating a plurality of colors in the addressable color-controllable RGB LED nodes, each user-selectable color-control switch being associated with a corresponding one of the plurality of colors;

the control circuitry being operative to, for each one of all possible combinations of the user-selectable color-control switches which have been set, illuminate the addressable color-controllable RGB LED nodes along the decorative light strand with a color scheme corresponding to the user-selectable color-control switches which have been set, by:

identifying color data associated with the user-selectable color-control switches which have been set; and sending the color data over one or more data lines to addressable color-controllable RGB LED nodes associated with LED node address data.

2. The decorative light strand of claim 1, further comprising:

memory for storing the color data associated with the plurality of colors.

3. The decorative light strand of claim 1, wherein the plurality of colors include red, green, blue, and white.

4. The decorative lighting apparatus of claim 1, further comprising:

wherein the control circuitry is operative to illuminate the addressable color-controllable RGB LED nodes with a first color when a first user-selectable color-control switch is set for the first color.

5. The decorative lighting apparatus of claim 1, further comprising:

wherein the control circuitry is operative to illuminate a first color and a second color in the addressable color-controllable RGB LED nodes in a repeated interleaved pattern along the decorative light strand when a first user-selectable color-control switch is set for the first color and a second user-selectable color-control switch is set for the second color.

6. The decorative lighting apparatus of claim 1, wherein the possible combinations of the user-selectable color-control switches provide color schemes in the decorative lighting apparatus which correspond to U.S. holidays which include Christmas, Halloween, St. Patrick's Day, and Valentine's Day.

7. A year-round decorative lighting apparatus with selectable holiday color schemes, comprising:

a decorative light strand which may be hung by an end user;

a plurality of addressable color-controllable red-green-blue (RGB) light-emitting diode (LED) nodes along the decorative light strand;

a control circuitry;

a memory;

the memory for storing data for a plurality of holiday color schemes, each holiday color scheme associated with one or more different holiday colors;

a decorating selector which provides a plurality of user-selectable switch settings;

the control circuitry being operative to illuminate the addressable color-controllable RGB LED nodes along the decorative light strand with a different holiday color scheme for each user-selectable switch setting by:

selecting, from the memory, holiday color data for a holiday color scheme associated with a user-selectable switch setting; and sending the holiday color data over one or more data lines to addressable color-controllable RGB LED nodes associated with LED node address data, for illuminating the addressable color-controllable RGB LED nodes with the holiday color scheme in response to the user-selectable switch setting.

8. The decorative lighting apparatus of claim 1, wherein the plurality of holiday color schemes further comprise:

a Christmas holiday color scheme which includes the colors red and green;

a Halloween holiday color scheme which includes the color orange; and a New Year's holiday color scheme which consists of the color white.

9. The decorative lighting apparatus of claim 1, wherein the plurality of holiday color schemes further comprise:

a Christmas holiday color scheme which includes the colors red and green;

a Halloween holiday color scheme which includes the color orange;

an Independence Day holiday color scheme which consists of the colors red, white, and blue;

a Valentine's Day holiday color scheme which includes the color red; and a St. Patrick's Day holiday color scheme which includes the color green.

10. The decorative lighting apparatus of claim 1, further comprising:

a wireless receiver which is coupled to the control circuitry; and a wireless remote controller having the decorating selector which provides the plurality of user-selectable switch settings.

11. The decorative lighting apparatus of claim 1, wherein at least some holiday color schemes are associated with two or more different holiday colors which are illuminated in a repeated interleaved pattern along the decorative light strand.

12. The decorative lighting apparatus of claim 1, wherein the plurality of holiday color schemes include at least four different U.S. holiday color schemes.

13. The decorative lighting apparatus of claim 12, further comprising:

a housing to which the decorative light strand may be attached; and the control circuitry and the memory carried in the housing.

14. A year-round decorative lighting apparatus with user-selectable color schemes, comprising:

a decorative light strand which may be hung by an end user;

a plurality of addressable color-controllable red-green-blue (RGB) light-emitting diode (LED) nodes along the decorative light strand;

a control circuitry;

a memory;

a housing to which the decorative light strand may be attached;

the control circuitry and the memory contained within the housing;

the memory for storing data for at least five (5) color schemes including U.S. holiday color schemes associated with at least Christmas, Independence Day, Halloween, Valentine's Day, and St. Patrick's Day;

a decorating selector comprising a keypad which provides a plurality of user-selectable switch settings;

the control circuitry being operative to illuminate the addressable color-controllable RGB LED nodes along the decorative light strand with a different color scheme for each user-selectable switch setting by:

selecting, from the memory, color data for a color scheme associated with a user-selectable switch setting; and sending the color data over one or more data lines to addressable color-controllable RGB LED nodes associated with LED node address data, for illuminating the addressable color-controllable RGB LED nodes with the color scheme in response to the user-selectable switch setting.

15. The decorative lighting apparatus of claim 14, wherein the at least ten color schemes further include at least two color schemes selected from the group consisting of: Easter, Mardi Gras, and Cinco De Mayo.

16. The decorative lighting apparatus of claim 15 wherein, for color schemes having at least two colors, the at least two colors are illuminated in a repeated interleaved pattern along the decorative light strand.

17. The decorative lighting apparatus of claim 15, wherein the color schemes include a plurality of sports team color schemes.

18. The decorative lighting apparatus of claim 15, wherein the keypad is carried with the housing.

19. The decorative lighting apparatus of claim 15, further comprising:

a wireless receiver which is coupled to the control circuitry within the housing; and a wireless remote controller which includes the keypad.

20. A method of year-round holiday lighting with a decorative light strand, comprising:

providing a decorative light strand which may be hung by an end user;

in response to a first user switch setting of the decorative light strand, providing for a selective illumination of at least two holiday colors in the decorative light strand in accordance with a first holiday color scheme by sending first color data associated with the at least two holiday colors to different sets of addressable color-controllable red-green-blue (RGB) light-emitting diode (LED) nodes along the decorative light strand; and in response to a second user switch setting of the decorative light strand, providing for a selective illumination of at least two holiday colors in the decorative light strand in accordance with a second holiday color scheme by sending second color data associated with the at least two holiday colors to different sets of the addressable color-controllable RGB LED nodes along the decorative light strand.

21. The method of claim 20, further comprising:

in response to a third user switch setting of the decorative light strand, providing for a selective illumination of at least two holiday colors in the decorative light strand in accordance with a third holiday color scheme by sending third color data corresponding to the at least two holiday colors to the addressable color-controllable RGB LED nodes along the decorative light strand.

22. The method of claim 20, wherein the first holiday color scheme comprises an Independence Day holiday color scheme.

23. The method of claim 20, wherein the first holiday color scheme comprises a Christmas holiday color scheme and the second holiday color scheme comprises an Independence Day holiday color scheme.

24. The method of claim 20, further comprising:

wherein the selective illumination of the at least two colors in the decorative light strand in accordance with the first holiday color scheme comprises the at least two colors being illuminated in a repeated interleaved pattern along the decorative light strand; and wherein the selective illumination of the at least two colors in the decorative light strand in accordance with the second holiday color scheme comprises the at least two colors being illuminated in a repeated interleaved pattern along the decorative light strand.

25. The method of claim 20, wherein the decorative light strand includes a housing to which the decorative light strand may be attached, and control circuitry and memory which are carried in the housing; and wherein the memory is for storing the first color data and the second color data, and the control circuitry is operative for sending the first and the second color data from the memory to the addressable color-controllable RGB LED nodes in response to the first and the second user switch settings, respectively.

* * * * *